US012677971B1

(12) United States Patent
Thompson-Goertz

(10) Patent No.: US 12,677,971 B1
(45) Date of Patent: Jul. 14, 2026

(54) DONNING ASSISTANCE APPARATUS

(71) Applicant: Lisa Thompson-Goertz, Ocala, FL (US)

(72) Inventor: Lisa Thompson-Goertz, Ocala, FL (US)

( * ) Notice: Subject to any disclaimer, the term of this patent is extended or adjusted under 35 U.S.C. 154(b) by 0 days.

(21) Appl. No.: 19/335,553

(22) Filed: Sep. 22, 2025

(51) Int. Cl.
*A47G 25/90* (2006.01)

(52) U.S. Cl.
CPC ..... *A47G 25/90* (2013.01)

(58) Field of Classification Search
CPC ..... A47G 25/90
See application file for complete search history.

(56) References Cited

U.S. PATENT DOCUMENTS 2,828,057 A * 3/1958 Maclauchlan ..... A47G 25/905 223/111
3,070,271 A 12/1962 Kennedy, Sr.
3,452,907 A * 7/1969 Maclaughlan ..... A47G 25/905 223/111
4,130,226 A * 12/1978 Farrell ..... A47G 25/905 223/111
4,789,087 A * 12/1988 Doorenbos ..... A47G 25/905 223/111
5,706,988 A 1/1998 Moore
5,769,289 A 6/1998 Lusk
5,884,371 A 3/1999 Huggins
5,975,384 A 11/1999 Manabat
6,932,252 B2 * 8/2005 Simmons ..... A47G 25/905 223/111
7,234,616 B2 * 6/2007 Thom ..... A47G 25/905 223/111
7,395,951 B2 7/2008 Clayman
(Continued)

FOREIGN PATENT DOCUMENTS

DE 29916762 U1 * 12/1999 ..... A47G 25/90
JP 3090910 U * 1/2003
JP 2007029239 A * 2/2007

OTHER PUBLICATIONS

Translation JP 2007029239.*
Translation JP 3090910.*
Translation DE 29916762.*

*Primary Examiner* — Shaun R Hurley
(74) *Attorney, Agent, or Firm* — Douglas Wm. Massinger, Esq.

(57) ABSTRACT

An assistive dressing device for donning lower-body garments from a standing or seated position by individuals with limited mobility or impaired upper limb function comprises a length-adjustable elongate curved frame comprising a first elongate curved frame member and a second elongate curved frame member; the first frame member and the second frame member being slidably engaged in partially overlapping fashion to form an overlapping portion of the frame; a first clip attached to the first frame member, and a second clip attached to the second frame member, each for securing a garment to the frame; and at least one tether mounted to the frame; whereby the length-adjustable frame may be adjusted to the approximate diameter of the opening of a lower-body garment, inserted into the opening, and selectively attached to garment edge defining the opening via the first and second clips to prepare for donning of the garment.

20 Claims, 5 Drawing Sheets

(56) References Cited

U.S. PATENT DOCUMENTS

| | | | | |
|---|---|---|---|---|
| 8,091,748 | B2 | 1/2012 | Whitlaw | |
| 8,857,679 | B2 * | 10/2014 | Skerman | A47G 25/908 223/111 |
| 9,186,010 | B2 | 11/2015 | Carbray | |
| 9,445,680 | B2 | 9/2016 | Bean et al. | |
| 9,936,832 | B2 | 4/2018 | McBroom et al. | |
| 10,292,517 | B1 | 5/2019 | Lawyer | |
| 10,918,234 | B1 | 2/2021 | Lawyer | |
| 11,213,154 | B1 | 1/2022 | Timothy | |
| D981,680 | S | 3/2023 | Ashcroft | |
| 11,622,641 | B1 | 4/2023 | Stacey | |
| 2005/0205619 | A1 | 9/2005 | Morel | |
| 2007/0095866 | A1 | 5/2007 | Zumbach | |
| 2009/0039118 | A1 | 2/2009 | Whitlaw | |
| 2009/0242593 | A1 * | 10/2009 | Hildebrandt | A47G 25/905 223/111 |
| 2010/0078450 | A1 | 4/2010 | Longhurst | |
| 2010/0193554 | A1 | 8/2010 | Atkinson | |
| 2010/0258600 | A1 * | 10/2010 | Pfistor | A47G 25/90 223/111 |
| 2011/0315724 | A1 | 12/2011 | Whitlaw | |
| 2015/0136815 | A1 * | 5/2015 | Clifton | A47G 25/90 223/112 |
| 2019/0159618 | A1 | 5/2019 | Kucera | |
| 2019/0335933 | A1 | 11/2019 | Leeper | |
| 2022/0296019 | A1 | 9/2022 | Rakauskas et al. | |
| 2024/0335054 | A1 * | 10/2024 | Grube | A47G 25/90 |

* cited by examiner

DONNING ASSISTANCE APPARATUS

FIELD OF THE INVENTION

The present invention relates generally to assistive devices for dressing, and more specifically to a device designed to aid individuals with limited reach, strength, flexibility, or balance, in donning lower-body garments, such as undergarments and pants, while in a seated position.

BACKGROUND OF THE INVENTION

Individuals with limited mobility or physical impairments often face significant challenges in performing everyday tasks, including dressing. The process of putting on clothing (referred to as "donning"), especially lower body clothing, typically requires a coordinated combination of balance, strength, flexibility, and dexterity. Many individuals with limited mobility, loss of strength, reduced balance, impaired hand function, chronic pain, or temporary injuries encounter significant difficulties when attempting to dress independently. Affected populations include (without limitation): older adults; persons with obesity; people with arthritis affecting the hands, hips, knees, or spine; individuals recovering from hip, knee, or spine surgery (often under "no bend/no twist" precautions); persons with neurologic conditions (e.g., stroke, Parkinson's disease, multiple sclerosis); individuals with temporary injuries (lumbar strain, lower-extremity fractures); and users with limb loss or reduced hand function. These limitations make it hard to open waistbands or sock mouths, thread the feet without excessive trunk flexion, and pull garments to knee or waist height while maintaining stability.

For example, the inability to bend at the waist, lift the legs, or stand on one foot poses a substantial barrier to pulling garments over the lower limbs. Such difficulties often lead to a loss of independence, reduced self-esteem, and increased reliance on caregivers, as supported by clinical studies and the ongoing development of occupational therapy interventions.

In rehabilitation settings, occupational therapists and other healthcare professionals work with patients to develop compensatory strategies and recommend adaptive equipment to promote independence in dressing. However, currently available tools may not adequately address the needs of individuals who must dress while seated and who have significantly impaired upper limb function. These individuals may struggle with devices that require complex manipulation or bilateral coordination, leading to frustration, increased dependence on caregivers, and delays in rehabilitation progress and return to independent living.

To address these challenges, numerous dressing aids have been proposed including rigid or semi-rigid "caddy" or trough-style devices that support a sock so a user can insert the foot and pull the garment on using long handles. For example, U.S. Pat. No. 6,932,252 issued to Simmons discloses a device with a U-shaped sock caddy and two pivotal long handles that both don and remove socks, intended for users unable to lean forward. Other stocking aids provide hinged U-shaped members on rigid rods to hold and tension the sock during application. See, U.S. Pat. No. 5,706,988 issued to Moore.

Compression garments amplify the need for mechanical advantage. U.S. Pat. No. 7,395,951 issued to Clayman teaches a "Stocking aid device" for expanding a compression stocking using opposed frames driven by a gear screw/spreader to enlarge the opening for easier foot insertion—addressing the high insertion forces of medical-grade hosiery.

Frame- and stand-based solutions hold lower-body garments open at floor level so the user can step in with minimal bending. An early adjustable stand system disclosed in U.S. Pat. No. 5,769,289 to Lusk sets opposed supports on a base to mount garments and permit one-handed donning. Later solutions generalize this concept into "dressing aids" that (i) expand a mounting portion to widen an opening, (ii) accept garments with one or two leg openings (e.g., briefs, pants, pantyhose), and (iii) include complementary undressing tools with spread guide portions to remove hosiery—explicitly aimed at users who cannot bend. See, for example, U.S. Patent Application Publication No. 20070095866 of Zumbach.

U.S. Patent Application Publication No. 20100193554 of Atkinson describes a device expressly "to assist in putting on trousers or underwear or incontinence pants," motivated by users with limited flexibility due to back or leg injury. U.S. Publication No. 20190159618 of Kucera discloses an "Aid for Putting on Pants" with a bow-shaped frame and handle used to spread leg openings, pull the garment upward, and transition control to the waistband. Additional disclosures such as U.S. Patent Application Publication Nos. 20090039118 of Whitlaw and 20050205619 of Morel teach strap-and-clip arrangements that attach to garment waistbands so users can pull pants up without deep trunk flexion, and broader systems that assist in donning undergarments and outer garments sequentially.

Each of the aforementioned solutions suffer from various shortcomings and limitations including requiring the user to stand, to have significant foot dexterity to locate the opening of the garment to be donned, or to possess significant grip strength and functional use of both hands to handle the apparatus. The requirement that both hands be functional, for instance, is particularly problematic for individuals recovering from a stroke, who may experience hemiparesis, resulting in weakness or paralysis on one side of the body, including limited or no functional use of an upper limb.

The inventor of the present device, having worked directly with stroke patients in clinical settings, observed firsthand the specific challenges associated with donning lower-body clothing in a seated position, particularly when one arm is non-functional. Accordingly, there has existed a long-standing need in the art for a donning assistance apparatus that does not suffer from the above shortcomings and limitations of the prior art.

SUMMARY OF THE INVENTION

The subject device is specifically designed to assist individuals in donning lower-body garments while seated, even with limited or no use of one arm. It has been observed to provide a more effective, user-friendly, and efficient solution than several apparatus of the prior art, and to enhance independence and improve quality of life for individuals with mobility impairments.

The subject invention meets the above-described need in the art by providing a novel assistive dressing device specifically designed to aid individuals with limited mobility or impaired upper extremity function in donning lower-body clothing, such as undergarments, pants, shorts, skirts, and the like, while in a seated position. Addressing the limitations of existing assistive tools—particularly for individuals with limited or no functional use of one arm—this invention offers a user-friendly, efficient, and adaptive solution that promotes independence in dressing.

More specifically, in one embodiment, the subject donning assistance apparatus comprises a length-adjustable elongate curved frame comprising a first elongate curved frame member and a second elongate curved frame member; the first frame member and the second frame member being slidably engaged in partially overlapping fashion to form an overlapping portion of the frame; a first clip attached to the first frame member, and a second clip attached to the second frame member; and at least one tether mounted to the frame; whereby the length-adjustable frame may be adjusted to a length that permits engagement with opposite sides of the inside wall of the garment's waistband, inserted into the opening defined by the waistband, and selectively attached to the garment via the first and second clips to prepare for donning of the garment.

In addition to one or more of the features described above or below, or as an alternative, in some embodiments the donning assistance apparatus comprises a length-adjustable elongate arcuate frame comprising a first elongate curved frame member having a first pair of parallel longitudinal slots, and a second elongate curved frame member having a second pair of parallel longitudinal slots; the first frame member and the second frame member being slidably engaged in partially overlapping fashion to form an overlapping portion of the frame; the first pair of parallel longitudinal slots being in communication with the second pair of parallel longitudinal slots; a fastener disposed through the pair of slots for preventing separation of the first frame member and the second frame member and permitting length adjustability of the overlapping portion of the frame; a first clip attached to the first frame member, and a second clip attached to the second frame member; and at least one tether mounted to the frame; whereby the length-adjustable frame may be adjusted to a length that permits engagement with opposite sides of the inside wall of the garment's waistband, inserted into the opening defined by the waistband, and selectively attached to the garment via the first and second clips to prepare for donning of the garment.

The adjustability allows the device to accommodate a range of hip widths, ensuring a proper and comfortable fit for a variety of users and garment sizes. When placed face-up on the floor immediately prior to donning of the garment, the arcuate configuration of the frame elevates a portion of the overlying garment's waistband off the ground to create an opening that is easily visualized and through which the feet may be inserted with greater ease than could be achieved when the opening to the garment is collapsed. This curvature therefore facilitates easier insertion of the feet and legs into the garment when secured on the device, particularly benefiting users with limited flexibility, balance, or lower extremity mobility or dexterity.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is, therefore, a primary object of the subject invention to provide a donning assistance apparatus for individuals with limited mobility or physical impairments, and one that is especially well-suited for donning lower-body clothing from a seated position, particularly when one arm of the user is non-functional.

It is also a primary object of the subject invention to provide a donning assistance apparatus that is a user-friendly, increases donning efficiency, and provides an adaptive solution for people with a wide variety of shapes and sizes, all to promote independence in dressing.

According to feature of the subject donning assistance apparatus, the tether component has a length that is at least substantially equivalent to the distance between the floor and the hands of a user in sitting position with the arms stretched alongside the body.

According to another feature of the device according to the invention, the tether may include means for adjusting its length.

Still another object of the subject invention is to provide a donning assistance apparatus that may be broken down into a highly compact and lightweight configuration for easy transport and storage.

It is another primary object of the subject invention to provide a donning assistance apparatus that is fabricated from materials that are durable, corrosion-resistant, and non-absorbent.

Another object of the subject invention is to provide a donning assistance apparatus that is fabricated from materials that are sufficient in weight and thickness to withstand repeated use and cleaning.

Another object of the subject invention is to provide a donning assistance apparatus that is fabricated from materials that may be finished to possess a smooth, easily cleanable surface.

Still another object of the subject invention is to provide a donning assistance apparatus that is fabricated from materials that are resistant to pitting, chipping, crazing, scratching, scoring, distortion and decomposition, and free of sharp external angles, corners, and edges which could cause injury.

Another object of the subject invention is to provide a donning assistance apparatus that is susceptible of a low cost of manufacture with regard to both materials and labor, and which accordingly is then susceptible of rapid construction and low prices of sale to the consuming public.

These together with other objects of the invention, along with the various features of novelty which characterize the invention, are pointed out with particularity in the claims annexed to and forming a part of this disclosure. For a better understanding of the invention, its advantages and the specific objects attained by its uses, reference should be had to the accompanying drawings and descriptive matter in which there is illustrated a preferred embodiment of the invention.

BRIEF DESCRIPTION OF DRAWINGS

The invention will be better understood and objects other than those set forth above will become apparent when consideration is given to the following detailed description thereof. Such description makes reference to the annexed drawings wherein corresponding reference numerals and characters indicate corresponding structural elements, portions or surfaces consistently throughout, as such elements, portions or surfaces may be further described or explained by the entire written specification. Elements in the several figures are illustrated for simplicity and clarity and have not necessarily been drawn to scale. For example, the dimensions of some of the elements in the figures may be emphasized relative to other elements for facilitating understanding of the various presently disclosed embodiments. Also, common, but well-understood elements that are useful or necessary in commercially feasible embodiment are often not depicted in order to facilitate a less obstructed view of these various embodiments of the present disclosure. One of ordinary skill in the art will also appreciate that a component may be designed as multiple components or that multiple components may be designed as a single component.

DETAILED DESCRIPTION OF THE INVENTION

1. Definitions and Meanings

Figure 1:
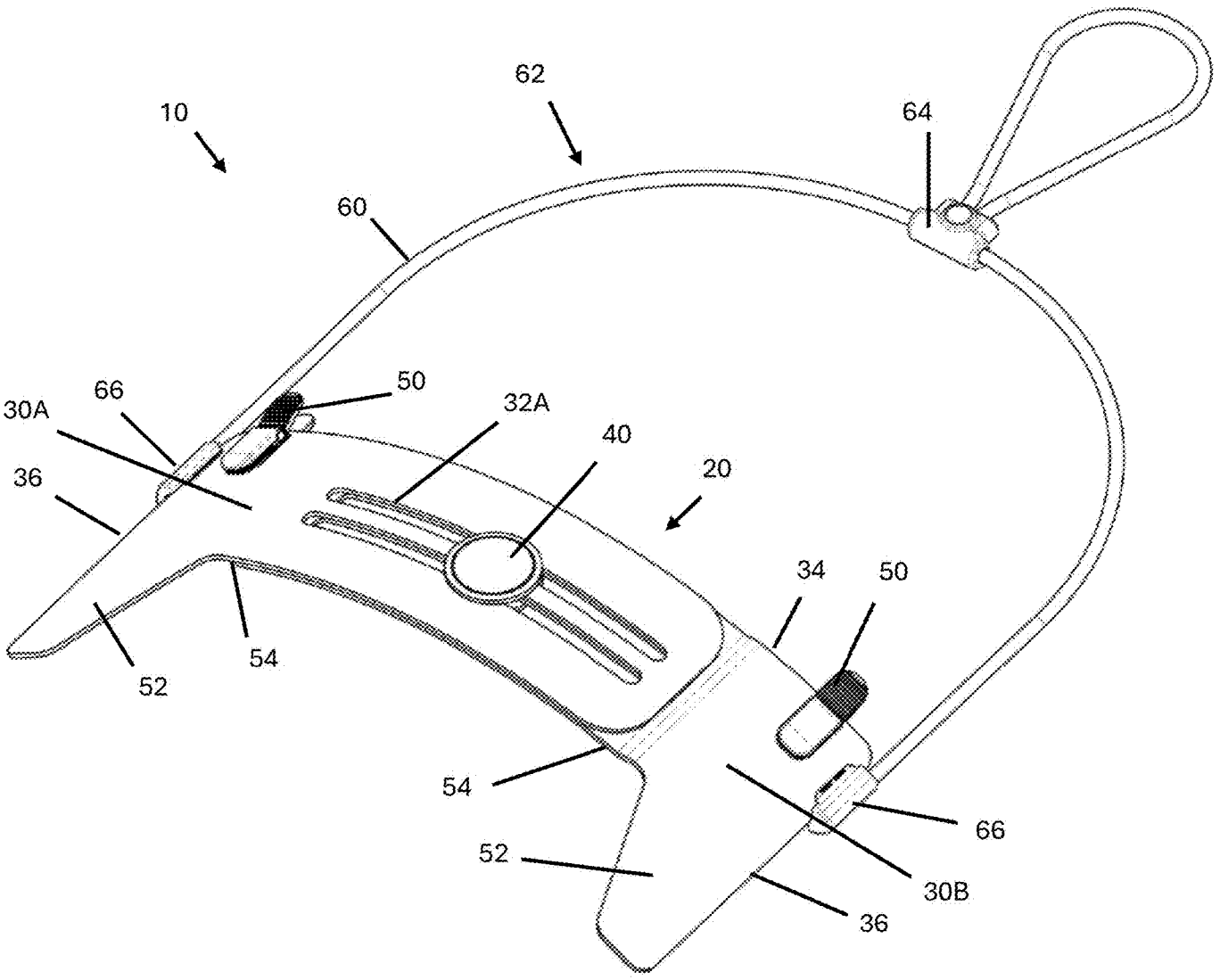
FIG. 1 is a front perspective view of a representative embodiment of a donning assistance apparatus of the subject invention.

Unless defined otherwise, all technical and scientific terms used herein have the same meaning as commonly understood by a person having ordinary skill in the art.

The present application may also reference quantities and numbers. Unless specifically stated, such quantities and numbers are not to be considered restrictive, but exemplary of the possible quantities or numbers associated with the present application. In this regard, the present application may use the term "plurality" to reference a quantity or number. In this regard, the term "plurality" is meant to be any number that is more than one, for example, two, three, four, five, etc. The phrases "at least one," "one or more," and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together, and further includes all similar permutations when any other quantity of elements is listed.

Where a range of values is provided, it is understood that each intervening value, to the tenth of the unit of the lower limit (unless the context clearly dictates otherwise), between the upper and lower limit of that range, and any other stated or intervening value in that stated range, is encompassed within the disclosure. The upper and lower limits of these smaller ranges may independently be included in the smaller ranges and are also encompassed within the disclosure, subject to any specifically excluded limit in the stated range. Where the stated range includes one or both of the limits, ranges excluding either or both of those included limits are also included in the disclosure.

The terms "about," "approximately," "near," etc. generally refer to a range of numbers that one of skill in the art would consider equivalent to the recited value (for example, having the same function or result). In many instances, these terms may include numbers that are rounded to the nearest significant figure. Unless otherwise stated, as used herein, the terms "about," "approximately," "near," etc., mean plus or minus 20 percent of the recited value, so that, for example, "about 0.125" means 0.125±0.025, and "about 1.0" means 1.0±0.2. All numeric values are herein assumed to be modified by the term "about," whether or not explicitly indicated.

Additionally, to the extent that linear or circular dimensions are used in the description of the disclosed systems, devices, and methods, such dimensions are not intended to limit the types of shapes that can be used in conjunction with such systems, devices, and methods. A person skilled in the art will recognize that an equivalent to such linear and circular dimensions can easily be determined for any geometric shape.

In everyday usage, indefinite articles (like "a" or "an") precede countable nouns and noncountable nouns almost never take indefinite articles. It must be noted, therefore, that, as used in this specification and in the claims that follow, the singular forms "a," "an," and "the" include plural referents unless the context clearly dictates otherwise. Thus, for example, reference to "a support" includes a plurality of supports. Particularly when a single countable noun is listed as an element in a claim, this specification will generally use a phrase such as "a single." For example, "a single support."

The present application may include references to directions or locations, such as "forward," "rearward," "front," "rear," "upward," "downward," "top," "bottom," "right hand," "left hand," "lateral," "medial," "proximal," "distal," "in," "out," "extended," etc., as well as adjectival and adverbial derivatives thereof (e.g., "horizontally," "rightwardly," "upwardly," "proximally," "distally," etc.). These references, and other similar references in the present application, are only to assist in helping describe and to understand the particular embodiment and are not intended to limit the present disclosure to these directions or locations. The terms "inwardly" and "outwardly" generally refer to the orientation of a surface relative to its axis of elongation, or axis of rotation, as appropriate.

The terms "comprising," "including," and "having" can be used interchangeably herein.

Also, as used herein, terms such as "positioned on" or "supported on" mean positioned or supported on but not necessarily in direct contact with the surface.

2. Embodiments of the Invention

Certain exemplary embodiments will now be described to provide an overall understanding of the principles of the structure, function, manufacture, and use of the device and methods disclosed herein. One or more examples of these embodiments are illustrated in the accompanying drawings. The detailed description set forth below in connection with the appended drawings are intended as a description of various embodiments of the present disclosure and are not intended to represent the only embodiments. Each embodiment described in this disclosure is provided merely as an example or illustration and should not be construed as precluding other embodiments. In the following description, specific details are set forth to provide a thorough understanding of exemplary embodiments of the present disclosure. It will be apparent to one skilled in the art, however, that the embodiments disclosed herein may be practiced without embodying all of the specific details. In some instances, well-known components or process steps have not been described in detail in order not to unnecessarily obscure various aspects of the present disclosure. Further, it will be appreciated that embodiments of the present disclosure may employ any combination of features described herein.

Furthermore, reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "in some embodiments", "one example" or "an example" in various places throughout this specification are not necessarily all referring to the same embodiment or example. Furthermore, the particular features, structures or characteristics may be combined in any suitable combinations and/or sub-combinations in one or more embodiments or examples.

All the features disclosed in this specification (including any accompanying claims, abstract, and drawings) may be replaced by alternative features serving the same, equivalent, or similar purpose, unless expressly stated otherwise. Thus, unless expressly stated otherwise, each feature disclosed is one example only of a generic series of equivalent or similar features. The examples and embodiments described herein are for illustrative purposes only and that various modifications or changes in light thereof will be suggested to the person having ordinary skill in the art and are to be included within the spirit and purview of this application. Many variations and modifications may be made to the embodiments of the disclosure without departing substantially from the spirit and principles of the disclosure. All such modifications and variations are intended to be included herein within the scope of this disclosure. For example, unless otherwise indicated, the present disclosure is not limited to particular materials, fasteners or other hardware, manufacturing processes, or the like, as such can vary. It is also to be understood that the terminology used herein is for purposes of describing particular embodiments only and is not intended to be limiting. It is also possible in the present disclosure that steps can be executed in different sequence where this is logically possible.

Figure 2:
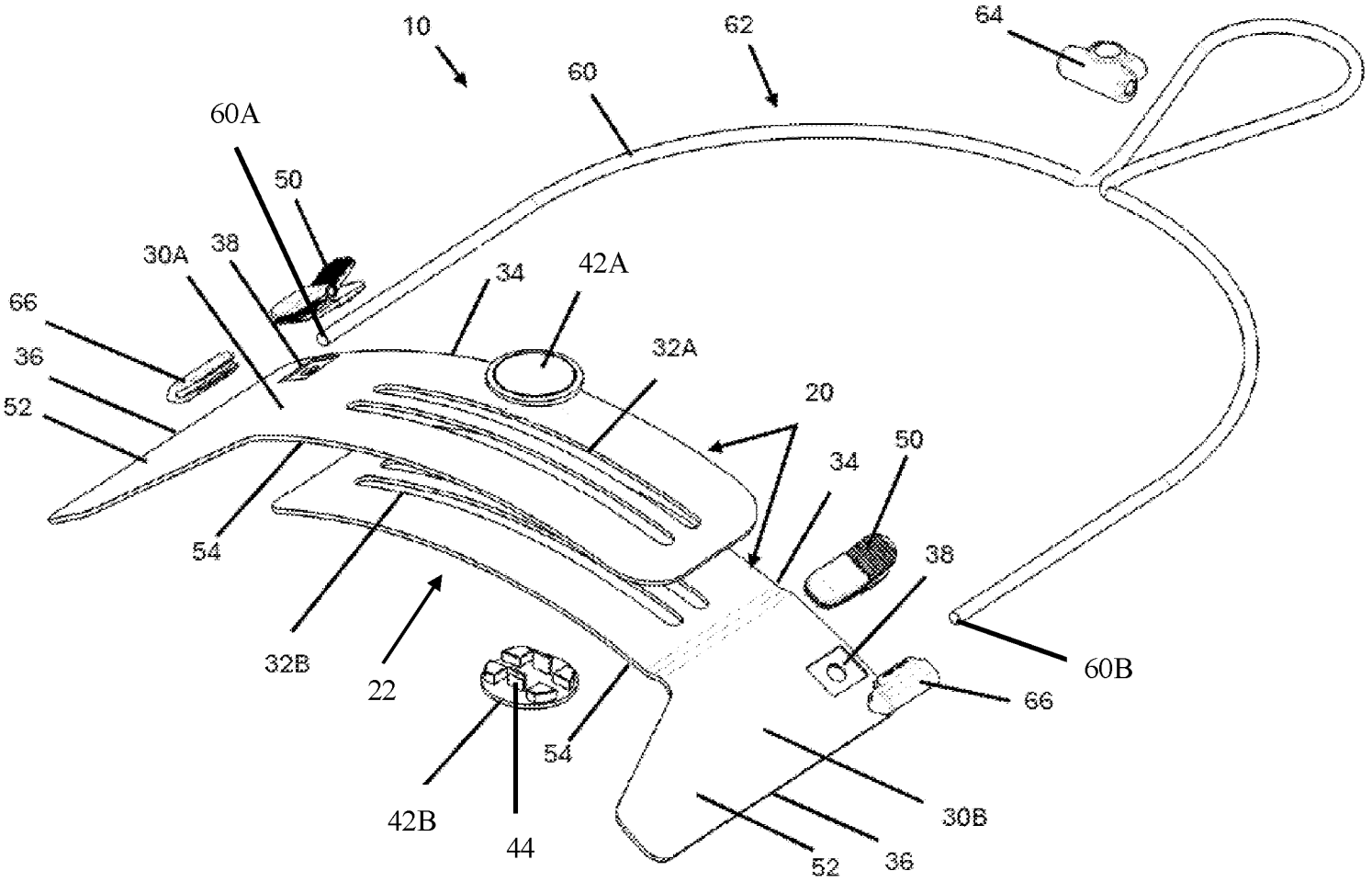
FIG. 2 is an exploded view of the donning assistance apparatus of FIG. 1.
Figure 3:
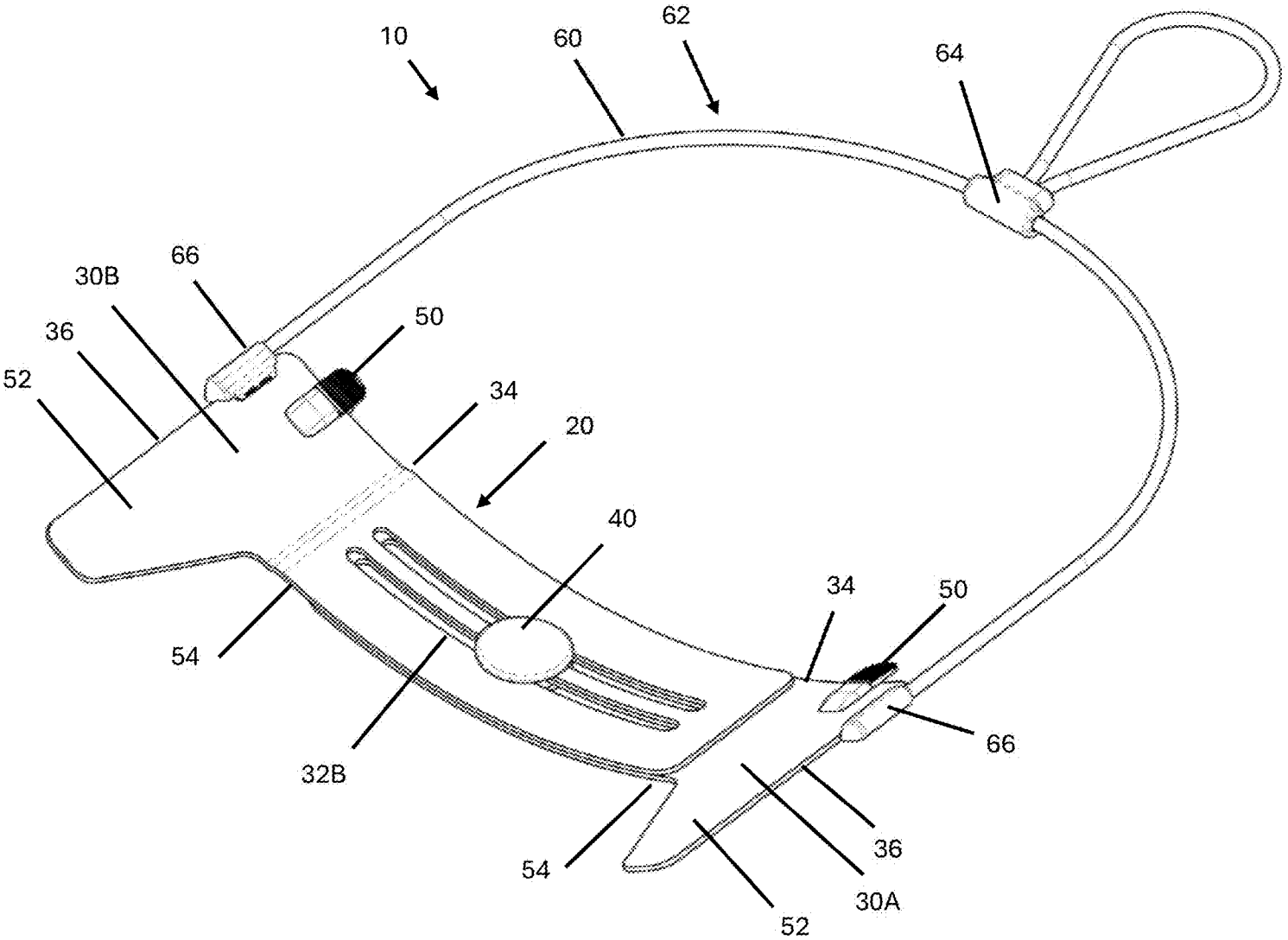
FIG. 3 is 1 is a rear perspective view of the donning assistance apparatus of FIG. 1.
Figure 4:
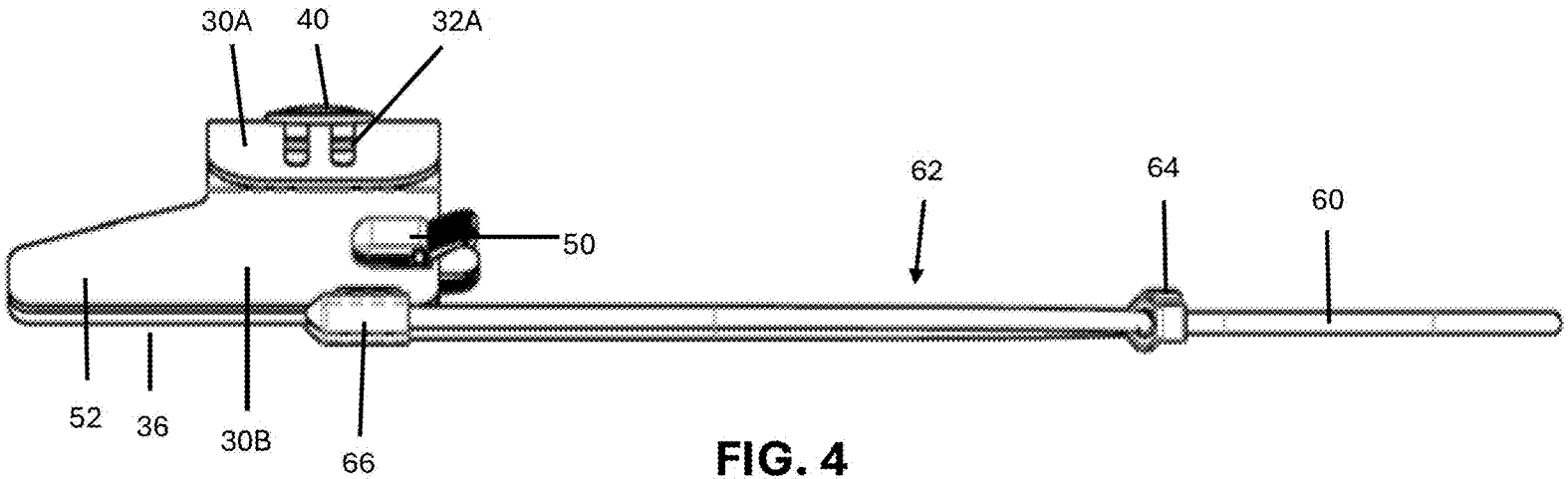
FIG. 4 is a left side view of the donning assistance apparatus of FIG. 1.
Figure 5:
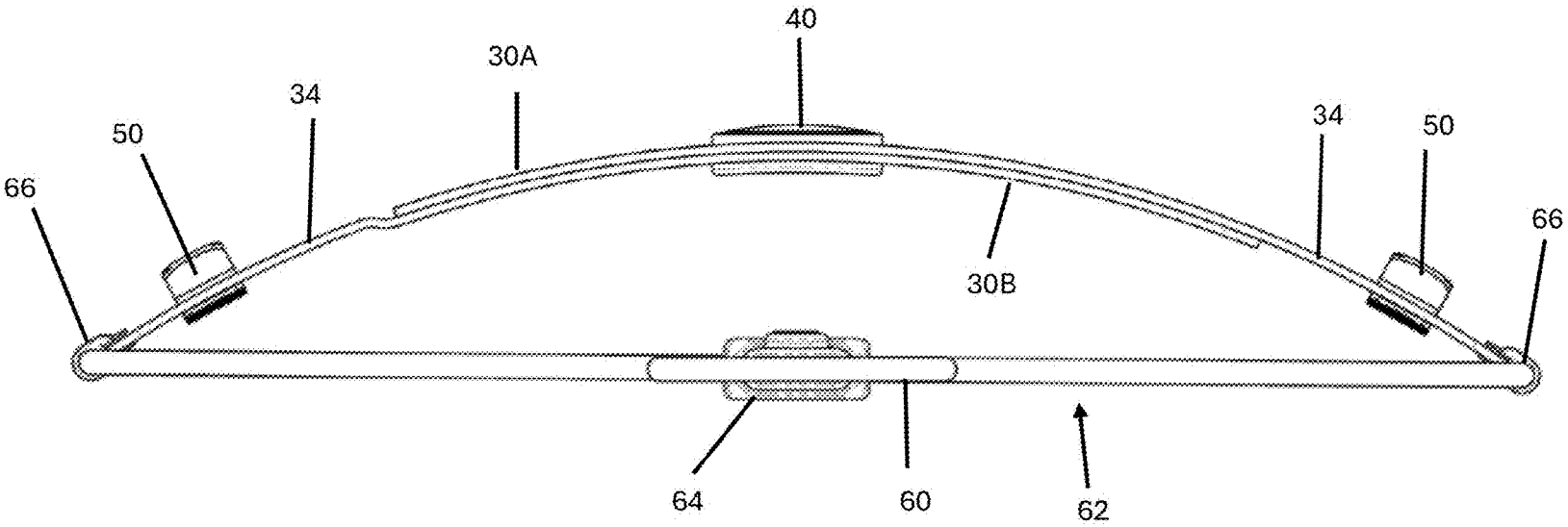
FIG. 5 is a top view of the donning assistance apparatus of FIG. 1.

With reference now being made to FIGS. 1-3, a first illustrative embodiment of the subject donning assistance apparatus is illustrated and identified generally by reference numeral 10. Donning assistance apparatus 10 (also referred to interchangeably herein as "dressing assistance device 10" or more simply as "the subject apparatus") includes three primary components, namely: 1) a frame 20 comprising first and second frame members 30A and 30B, 2) a pair of clips 50 for releasably securing a garment to the frame, and 3) a tether 60 attached to the frame for drawing the frame and attached garment onto the user's lower body. In some embodiments a fastener 40 for fastening frame members 30A,B together in sliding engagement is further provided. The terms "apparatus" and "device" are used herein interchangeably.

Frame 20 is length-adjustable, elongate in shape (i.e., longer than it is wide or tall), and possesses a curved longitudinal profile. In some embodiments, frame 20 has a relatively large curved surface area having a width that is at least about 25% of its length and in some embodiments can be up to about 100%. Frame 20 is comprised of first elongate curved frame member 30A having a first pair of parallel longitudinal slots 32A, and a second elongate curved frame member 30B having a second pair of parallel longitudinal slots 32B. Each frame member includes a proximal edge 34 and a lateral edge 36. Frame members 30A,B are slidably engaged to one another in partially overlapping fashion to form overlapping portion 22 of frame 20 with the first pair of parallel longitudinal slots 32A being in communication with the second pair of parallel longitudinal slots 32B. Thusly assembled, proximal edges 34 of frame members 30A,B combine to form a single proximal edge 34 of frame 20 and lateral edges 36 are oriented in parallel relationship to one another to serve as the "ground-contacting" surfaces of frame 20 during use (frame 20 will not have direct ground contact when a garment is properly mounted). In some embodiments each frame member 30A,B may have only one slot; in other embodiments multiple parallel slots may be employed. The terms "curved" as used herein should be construed broadly to include shapes that are arcuate, bowed, arched, elliptical, or other curved shapes. In some embodiments, frame 20 and each frame member 30A,B may be curvilinear in longitudinal profile so long as at least overlapping portion 22 is curved. In preferred embodiments, however, frame 20 is shaped to conform to the contour of a user's waist. In all embodiments, the extent of curve of each frame member 30A and 30B is identical such that frame members 30A and 30B possess a smooth, slidable, mating engagement with one another.

Fastener 40 is disposed through the pair of slots 32A,B for preventing separation of the first frame member 30A and the second frame member 30B, and permitting length adjustability of the overlapping portion 22 of the frame 20. As may be appreciated, the length of slots 32A,32B will dictate the degree of travel of frame members 30A,B relative to one another. As overlapping portion 22 decreases, the overall length of frame 22 increases, and vice versa, to accommodate a variety of garment waist sizes. The length of frame 20 can be adjusted to a maximum of about ninety (90%) percent of the length of a slot 32A,B.

Figure 7:
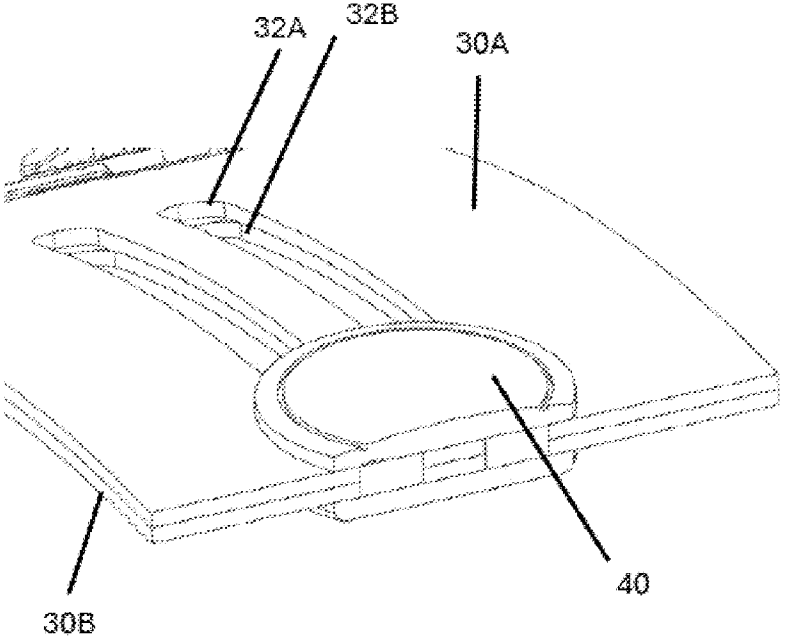
FIG. 7 is an enlarged sectional view of the representative fastener of FIG. 6 as mounted.
Figure 6:
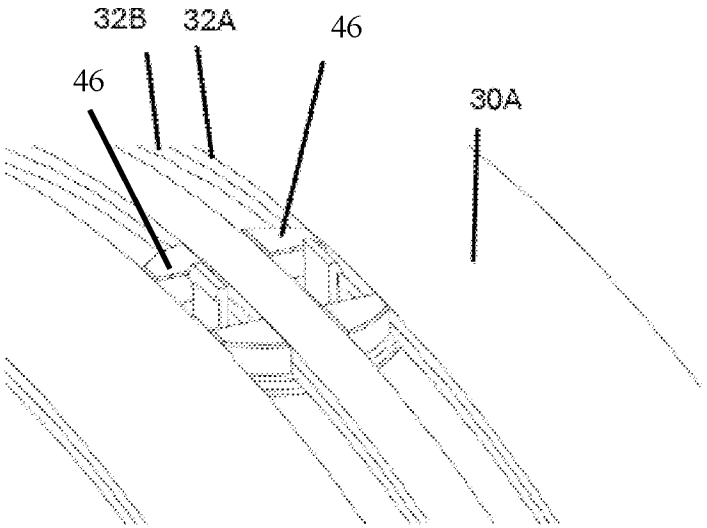
FIG. 6 is an enlarged view of the bottom component of a representative fastener of the subject apparatus as mounted through the slots of overlapping extension arms.

With reference now being made to FIGS. 6 and 7, in one embodiment, fastener 40 may be of the snap-fit variety that uses the flexibility of plastic to create a secure, tool-free, connection of its top and bottom disc-shaped halves 42A,B, respectively. One of the top or bottom halves 42A,B includes at least one protruding hook 44 which passed through a pair of overlapping slots 32A,B and briefly deformed by an external force to fit into a complementary receiving slot or undercut (not shown) on the mating part before snapping back into place to create the connection in a manner well known in the art. Popular types include cantilever snap fits, which rely on the bending of a flexible arm, and various L-shaped or U-shaped designs that interlock to secure parts. Materials like polypropylene (PP), polycarbonate (PC), and ABS are commonly used due to their flexibility, strength, and durability, making them suitable for the instant application. Alternative materials include nylon (PA) known for its toughness and high stress resistance, acetal (POM) for its low friction and good wear resistance for smooth operation. A pair of slides 46 extend from either the top or bottom halves 42A,B through each overlapping slot 32A,B in frictional engagement with its sidewalls to maintain longitudinal alignment of the slots, and therefore the frame members 30A,B, with one another. Fastener 40 and its components, and slots 32A,B on the other hand, are each sized and dimensioned with close tolerances to provide for a tight but not binding fit such that smooth sliding operation of frame members 30A,B is maintained. As should be readily appreciated, a variety of other types of fasteners may be employed including, without limitation, spring-loaded fasteners, ratcheting type fasteners, and screw-on fasteners to provide ease of length adjustability of frame 20 with selectable lock-in-place capabilities.

Referring once again to FIGS. 1-3, a pair of spring clips 50 are attached to frame 20; one on each frame member 30A,B. Clips 50 are designed to securely grip and retain the waistband or upper edge of a pair of pants, undergarments, or similar lower-body garment. The spring mechanism within each clip allows for easy opening and automatic clamping upon release, requiring minimal grip strength or manual dexterity from the user. Clips 50 are preferably strategically positioned in proximity to proximal edge 34 and lateral edge 36 of each frame member 30A,B such that clips 50 are spaced widely apart from one another. Thusly located, clips 50 retain the garment in an open and accessible orientation. When the garment is secured by both clips, the waistband between them remains taut to facilitate foot insertion into the garment opening.

Each clip 50 may be fitted into a recess 38 (FIG. 2) to help maintain a low profile and may be mounted in a variety of ways including with a screw, rivet or other fastener (typically through an eyelet located on the bottom of the clip), using an adhesive, weld or other methods known to those skilled in the art. Clips 50 may have a rubber or plastic coating to increase comfort and grip.

In some embodiments each frame member 30A,B includes a leg 52 extending distally from the frame member's distal edge 54, effectively extending the length of lateral edge 36, to form an overall L-shape of each frame member. For such embodiments, when mounted together in accordance with the teachings of the invention, frame members 30A,B form a frame 20 having a generally U-shape. Together the pair of legs 52 serve to lengthen lateral edge 36 in order to accommodate a greater amount of garment material therearound, much like rolling of a sock before donning. Ideally, enough of the garment material is gathered about frame 20 to permit legs 52 to enter the proximal leg openings of the garment to facilitate foot access thereto during donning.

In accordance with the recommended method of use of donning assistance apparatus 10 as further described below, at least one tether 60 is fixedly attached to each frame member 30A,B preferably in close proximity to the intersection of proximal edge 34 and lateral edge 36 such that the attachment points are spaced as widely apart as possible to facilitate independent control of the left and ride sides of frame 20. Each at least one tether 60 may take a variety of forms including, but not limited to, cords (as shown), string, rope, cable, chain, strap, or ribbon, and may be made of wide variety of materials selected based on desired physical properties including flexibility, tear resistance, non- or low-porosity, durability, surface texture and feel, weight, and cleanability. Examples of suitable synthetic materials are polyester, nylon, polypropylene and high-density polyethylene. Natural materials include but are not limited to waxed cotton and bamboo. Flexibility is desirable, but elasticity is not because a stretched tether could cause injury to the user if ruptured or detached from frame 20. In some embodiments such as is illustrated in FIGS. 1-5, a single tether 60 is attached to frame 20. More specifically, first end 60A of tether 60 is attached to first frame member 30A, and second end 60B of tether 60 is attached to second frame member 30B to form a loop 62. The size of loop 62 is a function of the length of tether 60. For those embodiments where tether 60 is in the form of a loop 62 as illustrated, a slide adjuster 64 may be used to shorten or lengthen loop 62. When tether 60 is a cord or string, slide adjuster 64 may be of the cord lock variety (also called a cord fastener, cord stop, or toggle stopper) in operable connection with tether 60. A typical cord lock includes a body having holes for one or more cords to pass through, a toggle or plunger that is squeezed to release the tension on the cord(s), and a spring mechanism for applying tension to the cord(s) for selectively securing the cord lock thereon in a desired location. Other types of slide adjusters 64 may be more suitable for different tether types as would be easily selected by those skilled in the art. Examples are triglide slides, ladder locks, and slide buckles. In some embodiments, a pair of tethers 60 may be employed; one being attached to frame member 30A; the other to frame member 30B. The free ends may be selectively tied together, however, in certain situations it may be more desirable for them to remain independent of one another. Each at least one tether 60 may be directly attached to a frame member, or indirectly such as through an intermediary structure. For instance, in the embodiment illustrated herein, each end of tether 60 is mounted within a sleeve of a coupler 66 which in turn is fixedly attached to a frame member 30A,B.

The materials used in the construction of donning assistance apparatus 10 are selected for ease of cleaning, light weight, portability, and durability under repeated use. Given that the apparatus 10 will be routinely placed on the floor as part of the donning method during use, and given further that the device is drawn across the user's uncovered lower extremities and lower torso, it is likely that the surfaces of the device will come into contact with and therefore collect dirt, skin, dead skin cells, skin secretions, and body lotions and powders, and also potentially bodily fluids. Accordingly, wherever possible, the surfaces of the apparatus are preferably non-porous which facilitates keeping the device in a sanitary condition by minimizing the collection of undesirable soil and fluids, including contaminants. When it comes to keeping surfaces sanitary, non-porosity is key. Using porous materials that can absorb water and subsequently hold onto it increases the chances of contamination from growing bacteria. Moreover, because the surfaces of the subject apparatus will be exposed to soiling and will require frequent cleaning, said surfaces shall be constructed of a corrosion-resistant, nonabsorbent, and smooth material. Such materials may not allow the migration of deleterious substances or impart colors or odors, and under normal use conditions shall be: safe, durable, corrosion-resistant, and nonabsorbent; sufficient in weight and thickness to withstand repeated washing; finished to have a smooth, easily cleanable surface; and resistant to pitting, chipping, crazing, scratching, scoring, distortion, and decomposition. Given the likelihood of exposure of the user's uncovered skin to the subject apparatus, the latter is preferably constructed to be free of sharp external angles, corners, and edges which could cause injury. The apparatus is also easily disassembled for cleaning.

For example, the body of the subject apparatus may be fabricated from high density polyethylene, a clean, white, high-impact plastic material that is almost unbreakable. As an alternative, the body may be fabricated from polypropylene to exhibit very high corrosion-resistance to acidic, alkaline and saline solutions. In this embodiment, the apparatus is satisfactory for service at temperatures up to 250° F. and can be sterilized. The polypropylene construction has high tensile strength and tremendous impact strength and very importantly has virtually no water absorption. Another viable alternative is to fabricate the apparatus from fiberglass which will provide a smooth surface with rounded corners for easy cleaning. Sturdy fiberglass won't dent, chip, bend, peel, crack or warp. Fiberglass is suitable for color coding of the apparatus and are impervious to washer temperatures and detergents and resistant to industrial cleaners. It will withstand continuous service from −40° F. to 250° F. with intermittent service as high as 300° F. Other suitable materials may also be employed.

To use the subject donning assistance device 10, the user may either stand or be seated; the device being especially advantageous for those who cannot stand. Frame 20 is first adjusted in length to engage opposite sides of the inside wall of the garment's waistband. The waistband of the garment is then clipped into place using the spring-tensioned clips 50, leaving the leg openings freely accessible between the two curved distal ends of legs 52. The user then lowers the apparatus and mounted garment to the floor while maintaining grasp of the tether 60 orienting the proximal edge 34 of each frame member 30A, B facing towards the user and the distal edge 54 facing away from the user. As may be best understood and appreciated upon reference to FIGS. 4 and 5, and as previously described, frame 20 is designed with a curved longitudinal profile. When donning assistance device 10 is placed face-up on the floor, the curved profile of frame 20 elevates a portion of the overlying garment's waistband off the ground to create an opening that is easily visualized and through which the feet may be inserted with greater ease than could be achieved when the opening to the garment collapses. This curvature facilitates easier insertion of the feet and legs into the garment held by the device, particularly benefiting users with limited flexibility, balance, or lower extremity mobility or dexterity. Moreover, the curved design frame 20 allows it to conform to and glide smoothly over the rounded shape of the legs and waist during the donning process, minimizing friction and resistance. The user pulls on tether 60 to draw the mounted garment over their feet and up over the legs and finally hips. This process requires only gross motor movements and does not necessitate bilateral coordination, making it accessible to individuals who can only use one hand or arm.

The above-described embodiments offer significant advantages over conventional dressing aids. The size-adjustable frame accommodates a wide range of body types and clothing sizes. The curved frame design facilitates foot entry into the waistband of the garment and conforms to the shape of the user's legs and torso for smooth donning. Together, these innovations allow users with significant physical impairments, such as those recovering from a stroke, to don lower-body garments more independently, reducing reliance on caregivers and improving quality of life. In essence, the subject dressing aid provides a practical, dignified, and highly functional solution for individuals facing mobility challenges. By enabling independent donning of lower-body clothing through its adaptive and novel frame design, the invention fosters greater autonomy, promotes rehabilitation, and enhances overall well-being for its users.

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

Although the present invention has been described with reference to the particular embodiments herein set forth, it is understood that the present disclosure has been made only by way of example and that numerous changes in details of construction may be resorted to without departing from the spirit and scope of the invention. Thus, the scope of the invention should not be limited by the foregoing specifications, but rather only by the scope of the claims appended hereto.

The invention claimed is:

1. An assistive dressing device, comprising:

a) a length-adjustable elongate arcuate frame comprising a first elongate curved frame member, and a second elongate curved frame member; the first frame member and the second frame member being slidably engaged in partially overlapping fashion to form an overlapping portion of the frame;

b) a first clip attached to the first frame member, and a second clip attached to the second frame member; and c) at least one tether mounted to the frame, wherein a first end of the at least one tether is attached to the first frame member and a second end of the at least one tether attached to the second frame member;

whereby the length-adjustable frame may be adjusted to a length that permits engagement with opposite sides of the inside wall of the garment's waistband, inserted into the opening defined by the waistband, and selectively attached to the garment via the first and second clips to prepare for donning of the garment.

2. An assistive dressing device, comprising:

a) a length-adjustable elongate arcuate frame comprising a first elongate curved frame member having a first pair of parallel longitudinal slots, and a second elongate curved frame member having a second pair of parallel longitudinal slots; the first frame member and the second frame member being slidably engaged in partially overlapping fashion to form an overlapping portion of the frame; the first pair of parallel longitudinal slots being in communication with the second pair of parallel longitudinal slots;

b) a fastener disposed through the pair of slots for preventing separation of the first frame member and the second frame member and permitting length adjustability of the overlapping portion of the frame;

c) a first clip attached to the first frame member, and a second clip attached to the second frame member; and d) at least one tether mounted to the frame;

whereby the length-adjustable frame may be adjusted to a length that permits engagement with opposite sides of the inside wall of the garment's waistband, inserted into the opening defined by the waistband, and selectively attached to the garment via the first and second clips to prepare for donning of the garment.

3. The assistive dressing device of claim 1, wherein the clips are spring-tensioned clips.

4. The assistive dressing device of claim 2, wherein the clips are spring-tensioned clips.

5. The assistive dressing device of claim 1, wherein the at least one tether is a single tether attached to the frame as a loop to facilitate one-handed use of the device.

6. The assistive dressing device of claim 2, wherein the at least one tether is a single tether attached to the frame as a loop to facilitate one-handed use of the device.

7. The assistive dressing device of claim 5, further including a slide adjuster operably mounted to the single tether for adjusting the size of the loop.

8. The assistive dressing device of claim 6, further including a slide adjuster operably mounted to the single tether for adjusting the size of the loop.

9. The assistive dressing device of claim 1, wherein the first frame member and second frame member each include a distal edge and a leg extending distally from the distal edge.

10. The assistive dressing device of claim 2, wherein the first frame member and second frame member each include a distal edge and a leg extending distally from the distal edge.

11. The assistive dressing device of claim 1, wherein the frame is constructed from materials selected from the group consisting of high density polyethylene, polypropylene and fiberglass.

12. The assistive dressing device of claim 2, wherein the frame is constructed from materials selected from the group consisting of high density polyethylene, polypropylene and fiberglass.

13. The assistive dressing device of claim 1, wherein the at least one tether is a cord, string, rope, cable, chain, strap, or ribbon.

14. The assistive dressing device of claim 2, wherein the at least one tether is a cord, string, rope, cable, chain, strap, or ribbon.

15. The assistive dressing device of claim 1, wherein the at least one tether is constructed from materials selected from the group consisting of polyester, nylon, polypropylene, high-density polyethylene, waxed cotton and bamboo.

16. The assistive dressing device of claim 2, wherein the at least one tether is constructed from materials selected from the group consisting of polyester, nylon, polypropylene, high-density polyethylene, waxed cotton and bamboo.

17. The assistive dressing device of claim 1, wherein each of the first frame member and the second frame member comprise:

a proximal edge;

a distal edge;

a lateral edge; and a leg extending distally from the distal edge to extend a length of the lateral edge such that each of the first frame member and the second frame member form an overall L-shape and such that upon slidable engagement of the first and second frame member the frame forms an overall U-shape.

18. The assistive dressing device of claim 17, wherein the first end of the at least one tether is secured to the first frame member adjacent to an intersection of the proximal edge and the lateral edge of the first frame member and wherein the second end of the at least one tether is secured to the second frame member adjacent to an intersection of the proximal edge and the lateral edge of the second frame member.

19. The assistive dressing device of claim 1, wherein:

the at least one tether is a single tether and wherein the single tether forms a loop extending from the first frame member to the second frame member;

the length-adjustable elongate arcuate frame has a curvature configured to conform to a waist of a user;

the frame has an adjustable length based on the slidable engagement between the first frame member and the second frame member to accommodate a range of hip widths of a user;

wherein the first clip and the second clip are configured to retain the garment waistband in an open position to facilitate foot and leg insertion through the open position; and wherein the device is free of sharp external angles, sharp corners and sharp edges.

20. An assistive dressing device, comprising:

a) a length-adjustable elongate arcuate frame comprising a first elongate curved frame member, and a second elongate curved frame member; the first frame member and the second frame member being slidably engaged in partially overlapping fashion to form an overlapping portion of the frame, wherein the first frame member and the second frame member each form an overall L-shape such that the frame forms an overall U-shape when the first frame member and the second frame member are slidably engaged;

b) a first clip attached to the first frame member, and a second clip attached to the second frame member; and c) at least one tether mounted to the frame such that the at least one tether forms a loop that extends from the first frame member to the second frame member;

whereby the length-adjustable frame may be adjusted to a length that permits engagement with opposite sides of the inside wall of the garment's waistband, inserted into the opening defined by the waistband, and selectively attached to the garment via the first and second clips to prepare for donning of the garment.

* * * * *